United States Patent [19]

Stark et al.

[11] 3,963,342

[45] June 15, 1976

[54] CURVED SCREEN

[75] Inventors: Howard M. Stark, Webster; Robert N. Goren, Rochester, both of N.Y.

[73] Assignee: Xerox Corporation, Stamford, Conn.

[22] Filed: Apr. 10, 1975

[21] Appl. No.: 566,886

[52] U.S. Cl. ..... 355/4; 355/11; 355/67

[51] Int. Cl.[2] ..... G03G 15/22

[58] Field of Search ..... 355/3, 4, 11, 17, 8, 355/67, 71

[56] References Cited

UNITED STATES PATENTS 3,120,790 2/1964 Carlson et al. ..... 355/3 R 3,517,596 6/1970 Johnson et al. ..... 355/4 X

*Primary Examiner*—L. T. Hix
*Assistant Examiner*—Kenneth C. Hutchison
*Attorney, Agent, or Firm*—H. Fleischer; C. A. Green; J. J. Ralabate

[57] ABSTRACT

An electrophotographic printing machine in which an arcuate screen member has a curvature substantially equal to the curvature of an arcuate photoconductive member employed therein. The centers of curvature of the screen member and photoconductive member are located in substantial coincidence with one another.

10 Claims, 3 Drawing Figures

CURVED SCREEN

BACKGROUND OF THE INVENTION

This invention relates generally to an electrophotographic printing machine, and more particularly concerns an optical system having a curved screen for modulating the light image of an original document.

A typical electrophotographic printing machine exposes a charged photoconductive member to a light image of an original document. The irradiated areas of the photoconductive member are discharged recording thereon an electrostatic latent image corresponding to the original document. A development system moves a developer mix of carrier granules and toner particles into contact with the latent image recorded on the photoconductive member. Toner particles are attracted electrostatically from the carrier granules to the latent image. In this manner, a powder image is formed on the photoconductive member. Thereafter, the powder image is transferred to a sheet of support material. After transfer, the sheet of support material passes through a fusing device which permanently affixes the toner powder image thereto.

Multi-color electrophotographic printing employs this basic concept. However, in multi-color electrophotographic printing, each cycle is for a discrete color contained in the original document. Thus, multi-color printing requires the light image to be filtered so as to record an electrostatic latent image on the photoconductive member corresponding to a single color of the original document. This single color electrostatic latent image is developed with toner particles of a color complementary to the color of the filtered light image. Thereafter, the toner powder image is transferred to a sheet of support material. This process is repeated for successively differently colored light images. Each toner powder image is transferred, in superimposed registration with the prior toner powder image, onto the sheet of support material. In this way, a multi-layered toner powder image is formed which corresponds to the colors of the original document. Thereafter, this multi-layered toner powder image is permanently affixed to the sheet of support material forming a permanent color copy of the original document.

In most electrophotographic printing machines, tone gradations are difficult to form. This problem may be obviated by the utilization of screening method. Generally, a screening technique produces the effect of tone gradations by variations in the diameter of the half-tone dots or the width of the half-tone lines comprising the toner powder image created by the screen. In the highlight zones or regions of low optical density, the dots or lines are small increasing in size through the intermediate shades until they merge together in the shadow region. At the highlight end of the tone scale, there will be complete whiteness while at the shadow end nearly solid blackness. The foregoing is described in U.S. Pat. No. 2,598,732 issued to Walkup in 1952. Other patents exemplifying various screening techniques are U.S. Pat. No. 3,535,036 issued to Starkweather in 1970; U.S. Pat. No. 3,121,010 issued to Johnson et al. in 1964; U.S. Pat. No. 3,493,381 issued to Maurer in 1970; U.S. Pat. No. 3,776,633 issued to Frosch in 1973; and U.S. Pat. No. 3,809,555 issued to Marley in 1974. Recently filed applications describing different screening techniques are copending application Ser. No. 511,976 filed in 1974 and copending application Ser. No. 507,169 filed in 1974. In addition, copending application Ser. No. 556,027, filed in 1975, and 566,873, filed in 1975, also relate to different types of curved screens employed in electrophotographic printing machines.

It is well known that the illumination of an image point is in proportion to the $\cos^4$ of the angle between the illumination point and the image point. It can, therefore, be seen that the illumination on a photoconductive surface will fall off quite rapidly as the angle increases. Various techniques have been devised to compensate for this affect. Typically, a sheet of opaque material having a butterfly slit formed therein is employed. The area of the slit is inversely proportional to the illumination profile. In an exposure system of this type, the original document is positioned on a flat transparent platen. The scan lamps and lens move across the original document in synchronism with the rotation of the photoconductive drum. In this way, successive incremental areas of the original document are scanned forming a flowing light image which is projected through the slit. A well known characteristic of such slit exposure systems, i.e. wherein the original document is positioned on a flat platen and the light image passes through the slit onto a curved photoconductive member, is image smearing. Image smearing occurs even if the scan and drum velocity are perfectly synchronized. The loci of exposure points on the drum corresponding to a single point of the original document are defined by the intersection of a plane and a cylinder. The plane is defined by a point (the lens) and a line (normal) to the drum axis and containing any image point on the photoconductive drum. During a slit scan, the image point does not remain stationary on the drum, but rather suffers both lateral and longitudinal translations. Such image motion causes loss of resolution. If a screen member having a plurality of substantially equally spaced opaque lines were placed near the photoconductive surface wherein the lines were aligned parallel to the drum circumference, the lateral image motion would smear the modulation produced by the screen member. In extreme cases, the modulation could be destroyed near the edges of the drum, where smearing is a maximum. For typical drum radii, lens focal lengths, and slit widths, this lateral smearing is highly significant.

Accordingly, it is a primary object of the present invention to improve the optical system so that modulations produced by a screen will not be smeared.

BRIEF SUMMARY OF THE INVENTION

Briefly stated, and in accordance with the present invention, there is provided an electrophotographic printing machine having an arcuate photoconductive member.

Pursuant to the features of the present invention, the screen member has a curvature substantially equal to the curvature of the photoconductive member. The screen member is mounted in the printing machine with its center of curvature in substantial coincidence with the center of curvature of the photoconductive member.

BRIEF DESCRIPTION OF THE DRAWINGS

Other objects and advantages of the present invention will become apparent upon reading the following detailed description and upon reference to the drawings, in which.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
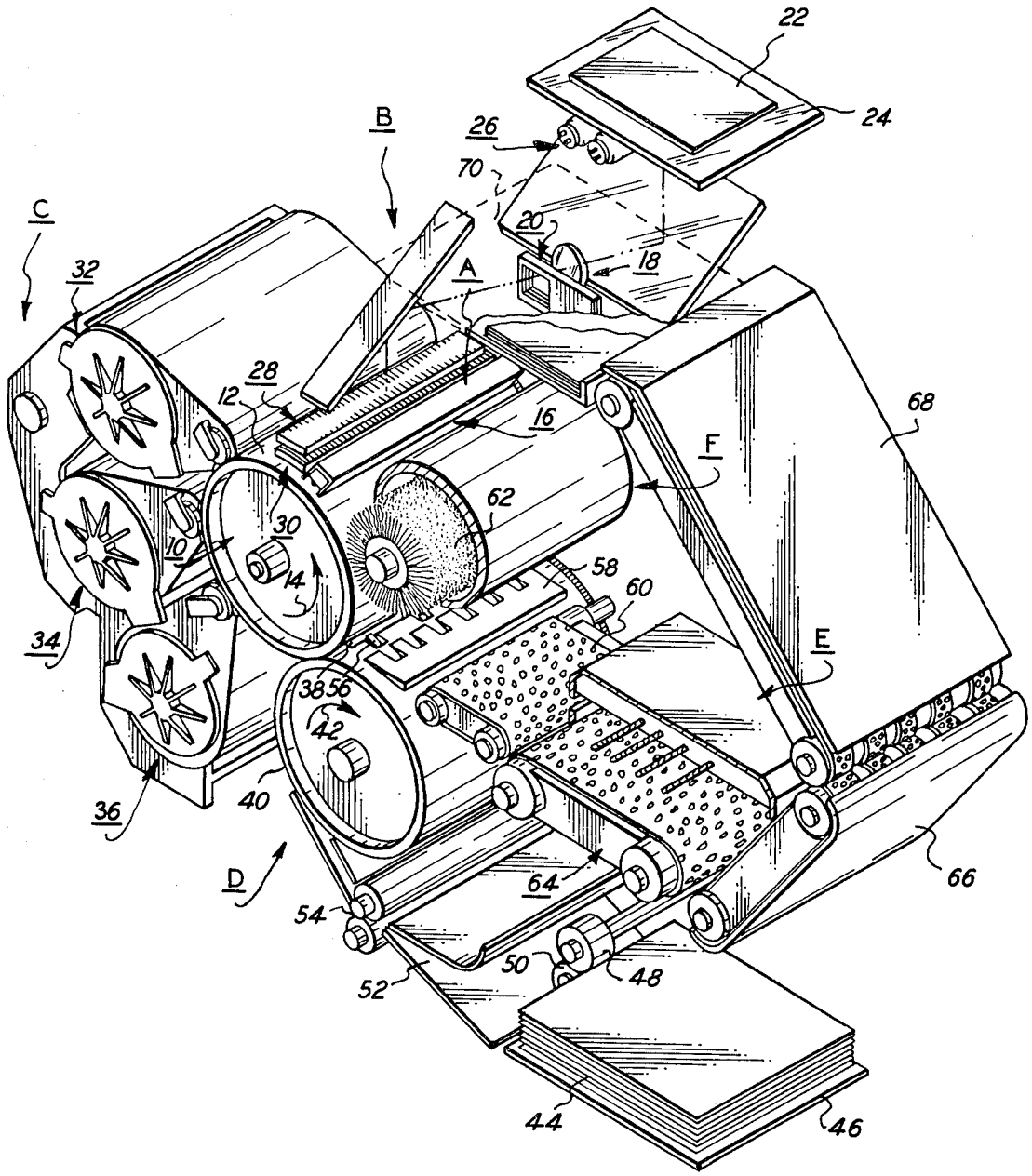
FIG. 1 is a schematic perspective view of an electrophotographic printing machine incorporating the features of the present invention therein.

For a general understanding of an electrophotographic printing machine, in which the present invention may be incorporated, reference is made to FIG. 1. In the drawings, like reference numerals will be used to designate like elements. FIG. 1 depicts a multi-color electrophotographic printing machine arranged to produce color copies from a colored original document. The original document may be in the form of single sheets, books or three dimensional objects.

Generally, an electrophotographic printing machine includes a photoconductive member having a rotatable drum 10 with a photoconductive surface 12 entrained about and secured thereto. Photoconductive surface 12 is made preferably from a polychromatic selenium alloy such as described in U.S. Pat. No. 3,655,377 issued to Sechak in 1972. A timing disc (not shown) is mounted at one end of the shaft of drum 10. This timing disc rotates in synchronism with drum 10 to activate the various processing stations sequentially for producing the desired event at the appropriate time.

For purposes of the present disclosure, the various processing stations operating in the electrophotographic printing machine will be briefly described hereinafter.

As drum 10 rotates in the direction of arrow 14, it passes through charging station A. Charging station A has positioned thereat a corona generating device, indicated generally by the reference numeral 16, which charges a portion of photoconductive surface 12 to a relatively high substantially uniform level. Corona generating device 16 extends in a generally transverse direction across photoconductive surface 12 producing a spray of ions for the charging thereof. Preferably, corona generating device 16 is of the type described in U.S. Pat. No. 2,778,946 issued to Mayo in 1957. After photoconductive surface 12 is charged, drum 10 rotates the charged portion thereof to exposure station B. At exposure station B, the charged area of photoconductive surface 12 is exposed to a color filtered light image of the original document. A moving lens system, generally designated by the reference numeral 18, and a color filter mechanism, shown generally at 20, are located at exposure station B. U.S. Pat. No. 3,062,108 issued to Mayo in 1952 describes a suitable drive mechanism for the lens system. Similarly, U.S. Pat. No. 3,775,006 issued to Hartman et al. in 1973 discloses a color filter mechanism suitable for use in the FIG. 1 electrophotographic printing machine. Preferably, lens 18 is a six element split dagor lens assembly. U.S. Pat. No. 3,592,531 issued to McCrobie in 1971 describes a lens assembly of this type adapted for use in a multi-color electrophotographic printing machine. Original document 22 is positioned upon transparent viewing platen 24 face down. This enables lamp assembly 26, positioned beneath transparent viewing platen 24, to illuminate the informational area of original document 22. Lamp assembly 26, lens system 18 and filter mechanism 20 move in a timed relationship with drum 10 to scan successive incremental areas of original document 22. In this manner, a flowing light image of original document 22 is created. This light image is projected through scan slit 28 and screen member 30 onto the charged portion of photoconductive surface 12. Irradiation of the charged portion of photoconductive surface 12 results in the selective discharge thereof. An electrostatic latent image corresponding to a single color of the informational areas contained in the original document is recorded on photoconductive surface 12. During exposure, filter mechanism interposes selected color filters into the optical light path. Successive color filters operate on the light rays passing through lens 18 to create a single color light image which is modulated by screen member 30. This records a single color electrostatic latent image on photoconductive surface 12. The detailed structural characteristic of the optical system employed in exposure station B will be described hereinafter, in greater detail, with reference to FIG. 2. Furthermore, the structure of screen member 30 and its relationship to drum 10 will also be discussed hereinafter in greater detail with reference to FIG. 3.

After the modulated single color electrostatic latent image is recorded on photoconductive surface 12, drum 10 rotates it to development station C. Development station C includes three developer units, generally designated by the reference numerals 32, 34 and 36. A suitable development station employing a plurality of developer units (in this case three) is described in U.S. Pat. No. 3,854,449 issued to Davidson in 1974. Each of the foregoing developer units is a magnetic brush developer unit. A typical magnetic brush developer unit employs a magnetizable developer mix having carrier granules and toner particles. The developer unit forms a directional flux field to continually create a brush of developer mix. This brush is brought into contact with the modulated single color electrostatic latent image recorded on photoconductive surface 12. The toner particles adhering electrostatically to the carrier granules of the developer mix are attracted by the greater electrostatic force to the latent image and render it visible. Developer units 32, 34 and 36, respectively, contain discretely colored toner particles. Each of the toner particles contained in the respective developer unit correspond to the complement of the color of the light image transmitted through filter 20. Hence, a modulated electrostatic latent image formed form a green filtered light image is rendered visible by depositing green absorbing magenta toner particles thereon. Similarly, modulated electrostatic latent images formed from blue and red light images are developed with yellow and cyan toner particles, respectively.

After the modulated electrostatic latent image recorded on photoconductive surface 12 is developed, drum 10 rotates the toner powder image to transfer station D. At transfer station D, the toner powder image adhering electrostatically to photoconductive surface 12 is transferred therefrom to a sheet of support material 38. A transfer roll, shown generally at 40, recirculates sheet 38. Transfer roll 40 is electrically biased to a potential of sufficient magnitude and polarity to electrostatically attract toner particles from photoconductive surface 12 thereto. A suitable electrically biased transfer roll is described in U.S. Pat. No. 3,612,677 issued to Langdon et al. in 1971. Transfer roll 40 is preferably the same diameter as drum 10 and rotates at substantially the same angular velocity in the direction of arrow 42. Thus, as transfer roll 40 rotates in synchronism with drum 10, successive toner powder images may be transferred from photoconductive surface 12 to sheet 38, in superimposed registration with one another.

Prior to proceeding with the remaining processing stations, the sheet feeding apparatus will be briefly described. With continued reference to FIG. 1, sheet 38 is advanced from stack 44 disposed upon tray 46. Feed roll 48, in operative communication with retard roll 50, separates and advances the uppermost sheet from stack 44. The advancing sheet moves into chute 52 is directed into the nip of register rolls 54. Register rolls 54 align and forward the advancing sheet, in synchronism with the movement of transfer roll 40, to gripper fingers 56 mounted therein. Gripper fingers 56 secure releasably support material 38 to transfer roll 40 for movement in a recirculating path therewith. Successive toner powder images are transferred to support material 38 in superimposed registration with one another forming a multi-layer toner powder image thereon. After transferring each of the toner powder images (in this case three) to support material 38, gripper fingers 56 space support material 38 from transfer roll 40. Stripper bar 58 is then interposed therebetween to separate support material 38 from transfer roll 40. Thereafter, endless belt conveyor 60 moves support material 38 to fixing station E.

After transferring the requisite number of toner powder images to support material 38, some residual toner particles remain adhering to photoconductive surface 12. Cleaning station F, the final processing station in the direction of rotation of drum 10, as indicated by arrow 14, removes these residual toner particles. A pre-clean corona generating device (not shown) neutralizes the charge on photoconductive surface 12 and that of the residual toner particles. This enables fibrous brush 62, in contact with photoconductive surface 12, to remove the residual toner particles therefrom. A suitable brush cleaning device is described in U.S. Pat. No. 3,590,412 issued to Gerbasi in 1971.

Returning now to fixing station E, the sheet of support material, which has been advanced to fixing station E, now has the multi-layered toner powder image adhering to support material 38 permanently affixed thereto. The foregoing is achieved by a fusing apparatus indicated generally by the reference numeral 64. Fuser 64 provides sufficient heat to permanently affix the multi-layered toner powder image to sheet 38. One type of suitable fusing apparatus is described in U.S. Pat. No. 3,826,892 issued to Draugelis et al. in 1974. After the fusing process, sheet 38 is advanced by endless belt conveyors 66 and 68 to catch tray 70 for subsequent removal therefrom by the printing machine operator.

It is believed that the foregoing description is sufficient for purposes of the present application to describe an electrophotographic printing machine having the features of the present invention incorporated therein.

Figure 2:
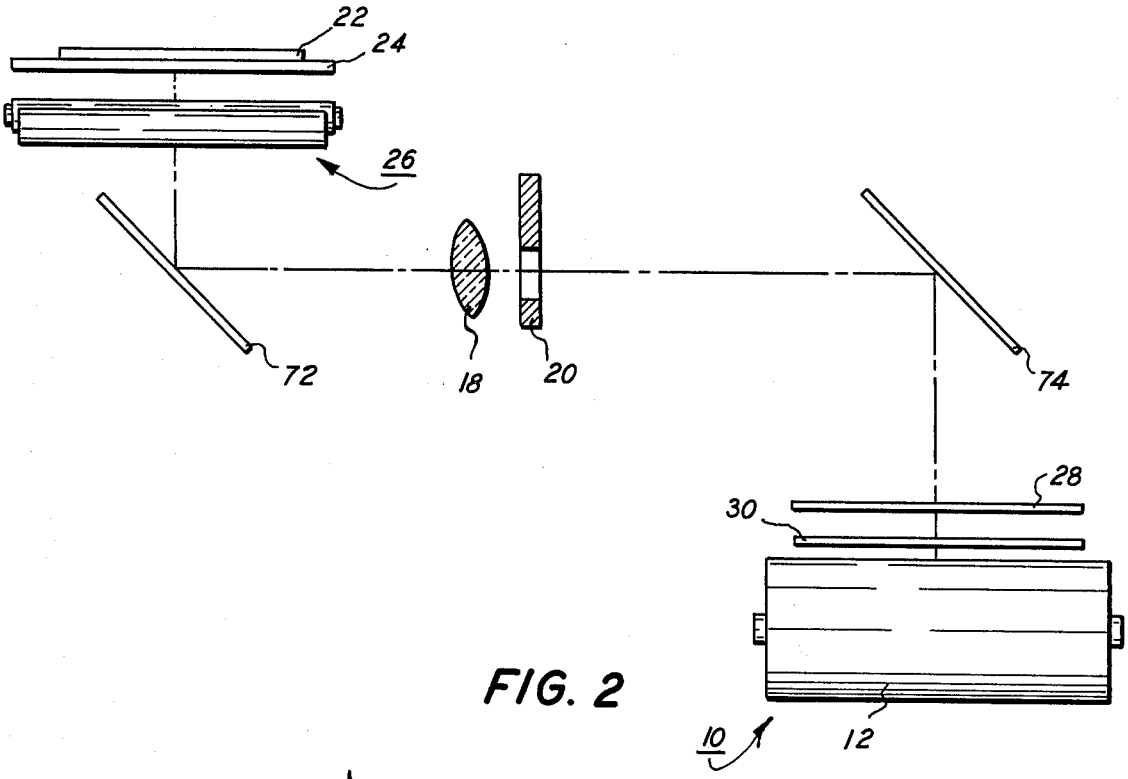
FIG. 2 is an elevational view of the optical system employed in the FIG. 1 printing machine.

Referring now to FIG. 2, exposure station B will be described hereinafter in greater detail. As shown, in FIG. 2, lamps 26 move across platen 24 illuminating original document 22 disposed thereon face down. Lens 18 and filter mechanism 20 move in synchronism therewith. The light rays reflected from original document 22 are reflected by mirror 70 through lens 18 and filter mechanism 20 forming a single color flowing light image thereof. This single color flowing light image is reflected by mirror 74 through scanning slit 28 and screen member 30 onto the charged portion of photoconductive surface 12 recording a single color electrostatic latent image thereon. Preferably, scan slit 28 is a flat sheet of opaque material such as sheet metal having a butterfly slit therein. Inasmuch as the slit is configured in the shape of a butterfly, image smear is accentuated. This results in loss of resolution and if a straight line screen were positioned adjacent photoconductive surface 12 with the opaque lines substantially parallel to the circumference of drum 10, the lateral motion would smear the modulaton produced by the screen member 30. Near the edges of drum 10, where smearing is greatest, modulation could be completely destroyed.

Screen member 30 is designed to correct this defect. To this end, screen member 30 is an arcuate member having a curvature substantially equal to the curvature of drum 10. Preferably, screen member 30 is a flexible transparent sheet having a plurality of spaced opaque lines thereon. The configuration of screen member 30 will be described hereinafter, in greater detail, with reference to FIG. 3. However, the curvature of screen member 30 is equal to the curvature of drum 10 with the radius of curvature of screen member 30 being greater than the radius of curvature of drum 10. This spaces screen member 30 from drum 10. In addition, the centers of curvature of screen member 30 and drum 10 are coincident with one another. Screen member 30 is positioned exactly in the printing machine by a suitable frame secured thereto such as by a pair of side rails. This insures uniform spacing between screen member 30 and photoconductive surface 12.

Figure 3:
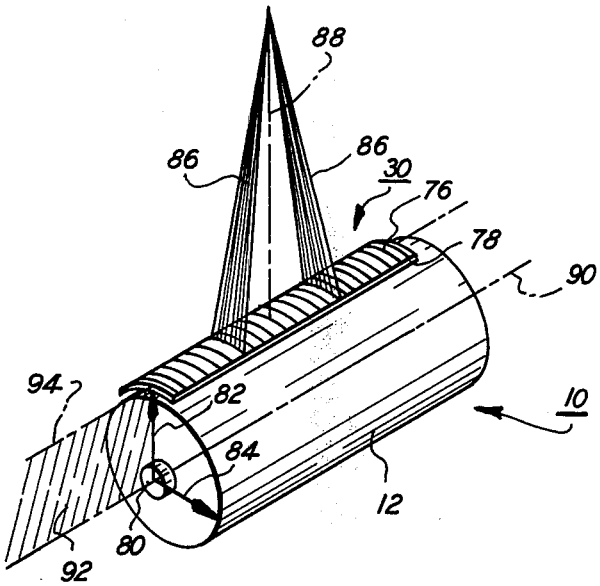
FIG. 3 is a perspective view depicting the relationship between the screen and photoconductive member of the FIG. 1 printing machine.

Referring now to FIG. 3, there is shown the detailed structure of screen member 30. Preferably, screen member 30 includes a flexible, substantially transparent sheet made from a suitable plastic such as Mylar. However, one skilled in the art will appreciate that a rigid pre-formed material, such as glass, may also be employed. A plurality of spaced opaque lines are disposed on the transparent sheet. Screen member 30 includes a plurality of lines printed on the transparent sheet by a suitable chemical etching or photographic technique. The screen itself, may be made from any number of opaque metallic materials suitable for chemical etching which are sufficiently thin to be flexible, such as copper or aluminum. As shown in FIG. 3, the centers of curvature 80 of screen member 30 and drum 10 are coincident with one another. The radius 82 of curvature of screen member 30 is greater than the radius 84 of curvature of drum 10. Each opaque line 76 is positioned to lie at the intersection of the plane defined by sheet 78 and a plane 86 having one point passing through a line 88 normal to the longitudinal axis 90 of drum 10 at a distance equal to the distance between lens 18 and drum 10, i.e. the image of lens 18 in mirror 74. In addition, plane 86 is normal to a plane 92 containing center line 94 of screen 38 and longitudinal axis 90 of drum 10 therein. The spacing between opaque adjacent lines determines the quality of the resulting copy. Conventionally, the lines will be equally spaced along center line 94 with the center screen line being straight and the other screen lines being curved symmetrically thereabout. A finer screen size generally results in a more natural or higher quality copy. Hence, while a coarse screen having 50 to 60 lines per linear inch will be useful for some purposes, finer screen such as those having anywhere from 100 to 400 or more lines per linear inch will form a copy having a nearly continuous toner appearance. With finer screens, the screen pattern may be barely perceptable on the finished copy and the copy will have the appearance of a continuous tone photograph. Preferably, the screen has about 120 lines to the linear inch.

By way of example, the radius 82 of curvature of screen member 30 is preferably about 0.100 inches greater than the radius 84 of curvature of drum 10. This defines the spacing between screen member 30 and drum 10.

In recapitulation, it is evident that the electrophotographic printing machine heretofore described incorporates an arcuate screen member having a curvature equal to the curvature of the photoconductive drum employed therein. In addition, the centers of curvature of the screen member and photoconductive drum are coincident with one another. The radius of curvature of the screen is greater than the radius of curvature of the drum so as to form a a preferred uniform spacing therebetween. Rulings curved in this way will not smear the image modulation.

It is, therefore, apparent that there has been provided in accordance with the present invention, an apparatus for producing copies that fully satisfies the objects, aims and advantages hereinbefore set forth. While the present invention has been described in conjunction with a preferred embodiment thereof, it is evident that may alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. An electrophotographic printing machine of the type having an arcuate photoconductive member, including:

an arcuate screen member having a curvature substantially equal to the curvature of the photoconductive member, said screen member being mounted in the printing machine with the centers of curvature of the photoconductive member and said screen member being in substantial coincidence with one another.

2. A printing machine as recited in claim 1, wherein said screen member has a radius of curvature greater than the radius of curvature of the photoconductive member defining a space therebetween.

3. A printing machine as recited in claim 2, further including:

means for charging the photoconductive member to a substantially uniform level; and means for projecting a light image of an original document being reproduced in the printing machine through said screen member irradiating the charged photoconductive member to record a modulated electrostatic latent image on the photoconductive member.

4. A printing machine as recited in claim 3, further including means for filtering the light image projected through said screen member onto the charged photoconductive member recording a modulated single color electrostatic latent image thereon.

5. A printing machine as recited in claim 4, further including:

means for developing the single color electrostatic latent image recorded on the photoconductive member with toner particles complementary in color to the color of the filtered light image transmitted through said screen member;

means for transferring the toner particles from the photoconductive member to a sheet of support material; and means for permanently affixing the toner particles to the sheet of support material.

6. A printing machine as recited in claim 5, wherein said screen member includes a transparent sheet member.

7. A printing machine as recited in claim 6, wherein said sheet member includes a plurality of spaced opaque lines thereon.

8. A printing machine as recited in claim 7, wherein said projecting means includes a lens spaced from the surface of the photoconductive member and adapted to form a light image of the original document.

9. A printing machine as recited in claim 8, wherein the spaced opaque lines located on said sheet member lie at the intersection of a first plane passing through said sheet member and a point located on a line normal to the longitudinal axis of the photoconductive member at said screen member.

10. A printing machine as recited in claim 9, wherein said projecting means includes a sheet of opaque material having a slit therein, said sheet being interposed between said lens and said screen member.

* * * * *